United States Patent [19]

Hudgins

[11] 4,086,829

[45] May 2, 1978

[54] SPEED HANDLE RATCHET

[76] Inventor: James L. Hudgins, Box 807, Cedar Crest, N. Mex. 87008

[21] Appl. No.: 769,415

[22] Filed: Feb. 17, 1977

[51] Int. Cl.[2] ..... B25B 23/14

[52] U.S. Cl. ..... 81/52.4 R; 81/57.29; 81/58.1; 64/30 R; 64/30 C

[58] Field of Search ..... 81/52.4 R, 52.4 A, 57.39, 81/58.1; 64/30 R, 30 C

[56] References Cited

U.S. PATENT DOCUMENTS

| | | | |
|---|---|---|---|
| 1,527,757 | 2/1925 | Street | 64/30 R |
| 2,797,564 | 7/1957 | Bonneau et al. | 81/52.4 R |
| 3,707,893 | 1/1973 | Hofman | 81/58.1 |
| 3,733,936 | 5/1973 | Flynn | 81/58.1 |

*Primary Examiner*—James L. Jones, Jr.
*Attorney, Agent, or Firm*—Tilton, Fallon, Lungmus & Chestnut

[57] ABSTRACT

A speed handle ratchet which can be used in either one of two distinct operating modes. The device includes an elongated handle having first and second ends, a head on one end of the handle, a hand grip on the other end of the handle, drive means connecting the hand grip to the head, ratchet means at the one end of the handle, and coupling means at the other end of the handle. The head is mounted for rotation about a first axis transverse to the handle and the hand grip is mounted for rotation about a second axis parallel to the handle. Rotation of the head in response to rotation of the hand grip is provided by the drive means. The handle is operatively joined to the head for rotation of the head in response to oscillation of the handle by the ratchet means, and the coupling means operatively joins the hand grip to the drive means. By utilizing this combination of elements, the coupling means transmits rotation of the hand grip through the drive means into rotation of the head for a first operating mode below a selected torque load level and prevents rotation of the hand grip by the drive means during rotation of the head in response to oscillation of the handle in a second operating mode above the selected torque load level.

12 Claims, 16 Drawing Figures

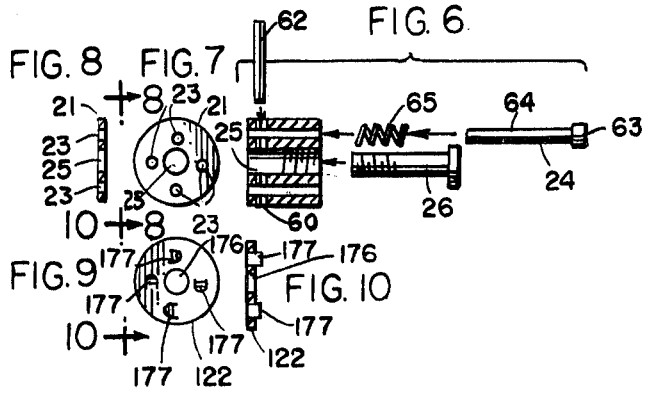
FIG. 6
FIG. 7
FIG. 8
FIG. 9
FIG. 10
62
65
64
63
24
26
60
21
23
25
8
10
176
177
122
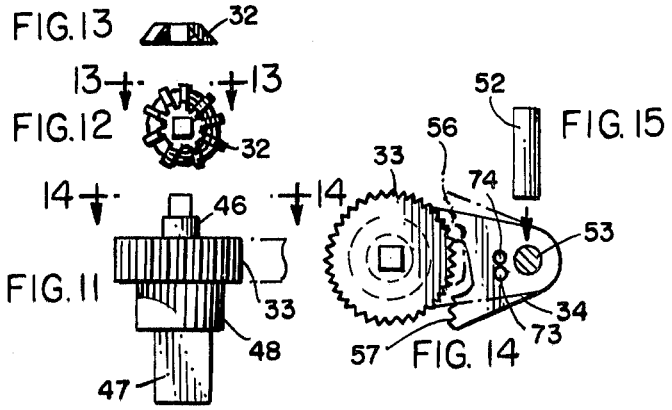
FIG. 13
FIG. 12
FIG. 11
FIG. 14
FIG. 15
32
13
14
46
33
48
47
52
56
74
53
34
73
57
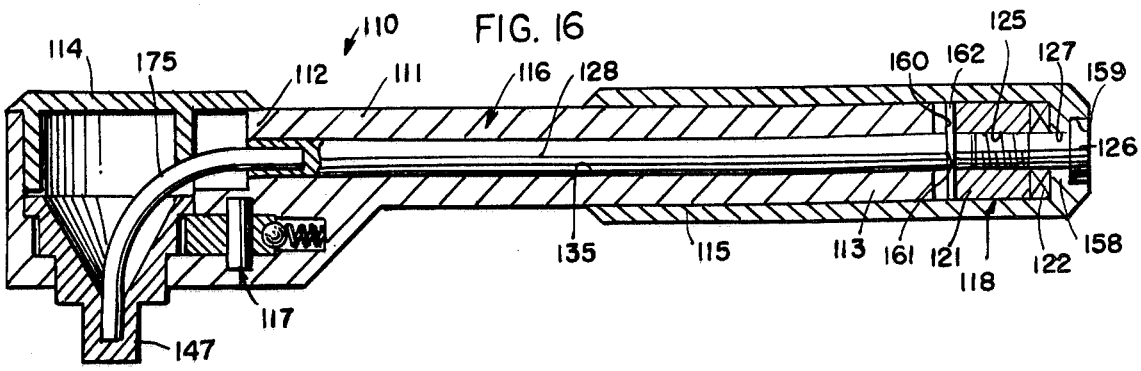
FIG. 16
110
114
175
112
111
116
128
160
162
125
127
159
126
135
115
113
161
121
118
122
158
117
147

SPEED HANDLE RATCHET

BACKGROUND

This invention relates to a speed handle ratchet and more particularly to a speed handle ratchet which can be used in either one of two distinct operating modes.

A conventional ratchet wrench includes structure whereby oscillation of the handle of the wrench will cause rotation of the head of the wrench for driving an associated socket member of the like. It is well known that ratchet wrenches are useful for quickly tightening and loosening a nut or a bolt particularly in applications where other types of wrenches will not reach. It is equally well known, however, that ratachet wrenches are somewhat difficult to use in applications where oscillation of the handle is limited. With these problems in mind, those skilled in the art sought means whereby rotary movement could be imparted to the head independent of oscillation of the handle of the conventional ratchet wrench. More recently, speed ratchets have been developed to overcome the limitations of conventional ratchet wrenches. It has been common to provide means associated with the handle whereby rotary movement may be imparted to the head independent of oscillation of the handle. An example of such prior art speed ratchets is disclosed in U.S. Pat. No. 3,707,893 illustrating a rotatable handle sleeve which may be rotated manually and without oscillation of the handle to rotate the head of the ratchet wrench to either tighten the associated nut or bolt until it becomes finger tight or remove the nut or bolt after it has been broken loose to a point at which it is no more than finger tight. It has been found, however, that the rotatable handle sleeve which must be manually disengaged in constructions heretofore available has proven to be a less than satisfactory feature. An example of the problems encountered includes disengagement difficulties with the extent of the problem depending upon the amount of gear stress which in turn is dependent upon the torque load applied during a tightening or loosening operation. It has also been found that the user will occasionally forget the required disengagement resulting in the handle sleeve slipping within the user's hands with the distinct possibility of causing injury or at the very least inconvenience. While the prior art has recognized the desirability and need for a speed ratchet, the present invention represents an improvement over all such prior art constructions.

SUMMARY

The present invention is directed to a speed handle ratchet which can be used in either one of two distinct operating modes. The device includes an elongated handle having first and second ends, a head on one end of the handle, a hand grip on the other end of the handle, drive means connecting the hand grip to the head, ratchet means at the one end of the handle, and coupling means at the other end of the handle. The head is mounted for rotation about a first axis transverse to the handle and the hand grip is mounted for rotation about a second axis parallel to the handle. Rotation of the head in response to rotation of the hand grip is provided by the drive means. The handle is operatively joined to the head for rotation of the head in response to oscillation of the handle, and the coupling means operatively joins the hand grip to the drive means. With these features of construction, the coupling means transmits rotation of the hand grip through the drive means into rotation of the head for a first operating mode below a selected torque load level and prevents rotation of the hand grip by the drive means during rotation of the head in response to oscillation of the handle in a second operating mode above the selected torque load level.

In one embodiment disclosed, the coupling means includes a clutch assembly having a first portion connected to the drive means and a second portion urged into firm frictional engagement with the hand grip. The first portion of the clutch assembly includes a cylindrical insert element having a plurality of radially disposed circumferentially spaced apertures therein with a spring loaded pin extending from each of the apertures in the insert element. The clutch assembly is adjustable to vary the selected torque load level with the cylindrical insert element including a threaded central aperture to receive a screw passing through an aperture in the hand grip.

The drive means includes a longitudinally extending rod having one end connected to the cylindrical insert element and having the other end connected to the head. The rod passes through a central bore in the handle with the end of the rod adjacent the head having a bevel gear secured thereto to mesh with a corresponding bevel gear fixed to the head. The drive means thereby connects the hand grip to the head for rotation of the head in response to rotation of the hand grip.

It is therefore an object of the present invention to provide a speed handle ratchet which can automatically be used in either one of two distinct operating modes as a result of the unique coupling means operatively joining the hand grip to the drive means. The provision of the structure and the realization of the advantages to be derived therefrom constitute additional important objects of the present invention. Still other objects of this invention will be appreciated from a consideration of the details of construction and operation which are set forth in the accompanying specification, claims and drawings.

DRAWINGS

The invention is described in conjunction with the accompanying drawings, in which:

FIG. 6 is a cross-sectional view illustrating the various components of the clutch assembly;

FIG. 7 is an end view illustrating a first portion of the clutch assembly of FIG. 6;

FIG. 8 is a cross-sectional view taken on the line 8—8 of FIG. 7;

FIG. 9 is an end view illustrating a second portion of the clutch assembly in another form of the present invention;

FIG. 10 is a cross-sectional view taken on the line 10—10 of FIG. 9;

FIG. 11 is a front view illustrating a wheel and lug of the head;

FIG. 12 is a top view illustrating a bevel gear of the head;

FIG. 13 is a cross-sectional view taken on the line 13—13 of FIG. 12;

FIG. 14 is a cross-sectional view taken on the line 14—14 of FIG. 13;

FIG. 15 is a front view illustrating a ratchet means pin being inserted into a pawl; and FIG. 16 is a cross-sectional view of a speed handle ratchet in another form of the present invention.

DESCRIPTION

Figure 1:
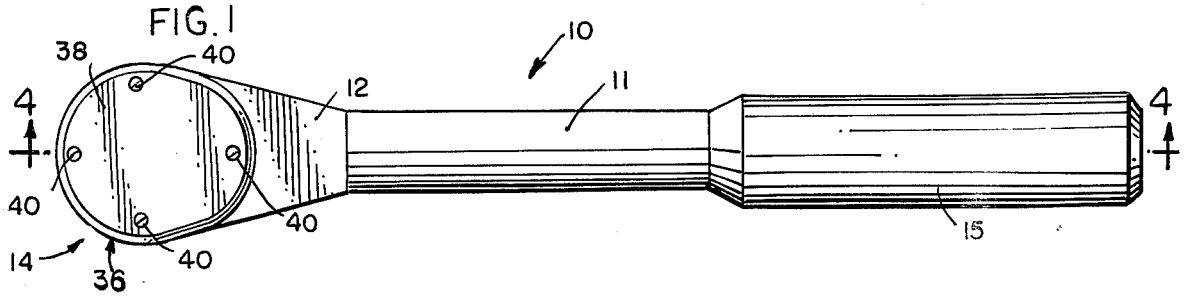
FIG. 1 is a top view of a speed handle ratchet in accordance with the present invention.
Figure 4:
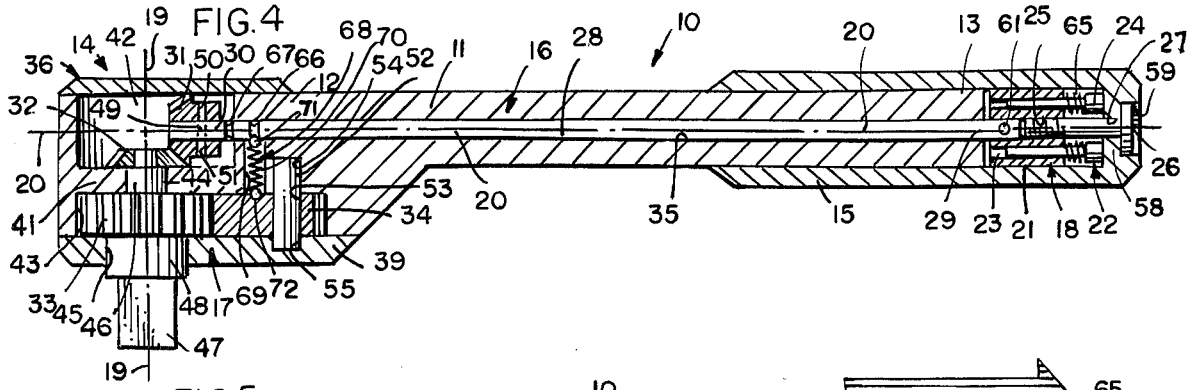
FIG. 4 is a cross-sectional view taken on the line 4—4 of FIG. 1.

In the illustration given and with reference first to FIG. 1, the numeral 10 designated generally a speed handle ratchet in accordance with the present invention. The ratchet 10 includes an elongated handle 11 having first and second ends 12 and 13, respectively, a head 14 on one end 12 of the handle 11, a hand grip 15 on the other end 13 of the handle 11, drive means 16 (as shown in FIG. 4) operatively joining the hand grip 15 to the head 14, ratchet means 17 at the one end 12 of the handle 11, and coupling means 18 at the other end 13 of the handle 11. The head 14 is mounted for rotation about a first axis 19 transverse to the handle 11 and the hand grip 15 is mounted for rotation about a second axis 20 parallel to the handle 11. Rotation of the head 14 in response to rotation of the hand grip 15 is provided by the drive means 16. The ratchet means 17 operatively joins the handle 11 to the head 14 for rotation of the head 14 in response to oscillation of the handle 11, and the coupling means 18 operatively joins the hand grip 15 to the drive means 16. With this construction, the coupling means 18 transmits rotation of the hand grip 15 through the drive means 16 into rotation of the head 14 below a selected torque load level and prevents rotation of the hand grip 15 by the drive means 16 during rotation of the head 14 in response to oscillation of the handle 11 above the selected torque load level.

The coupling means 18 is a clutch assembly having a first portion 21 connected to the drive means 16 and a second portion 22 urged into firm frictional engagement with the hand grip 15. The first portion 21 of the clutch assembly 18 is a cylindrical insert element having at least one aperture 23 and preferably a plurality of radially disposed circumferentially spaced apertures 23 therein (as shown in FIG. 7) with a spring loaded pin 24 extending from each of the apertures 23 in the insert element 21. The coupling means 18 is further characterized by the cylindrical insert element 21 having a threaded central aperture 25 (as shown in FIG. 6) to receive a screw 26 passing through an aperture 27 in the hand grip 15.

The drive means 16 includes a longitudinally extending rod 28 having one end 29 connected to the insert element 21 of the clutch assembly 18 and having the other end 30 connected in the head 14. The end 30 of the rod 28 adjacent the head 14 includes a bevel gear 31 to mesh with a corresponding bevel gear 31 in the head 14. The drive means 16 thereby connects the hand grip 15 to the head 14 for rotation of the head 14 in response to rotation of the hand grip 15.

The ratchet means 17 includes a wheel 33 mounted for rotational movement about the first axis 19 in the head 14. It is particularly advantageous in most applications for the ratchet means 17 to be reversible. The ratchet means 17 also includes a pawl 34 engageable with the wheel 33 mounted for pivotal movement about an axis parallel to but spaced from the first axis 19 in the handle 11.

Figure 5:
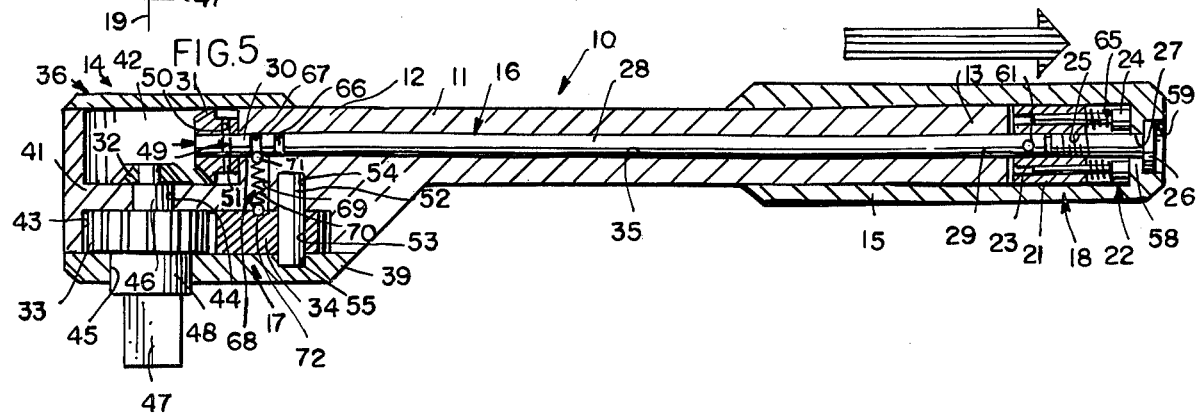
FIG. 5 is a cross-sectional view similar to FIG. 4 illustrating the drive means disengaged from the head.

Referring to FIGS. 4 and 5, additional details of construction of the speed handle ratchet 10 can be appreciated. The handle 11 is an elongated member having a central bore 35 therethrough to carry the rod 28. The end 12 of the handle 11 is enlarged to accommodate the components of the drive means 16 and the ratchet means 17 that operatively coact with the head 14. The enlarged end 12 of the handle 11 also adds strength to the speed handle ratchet 10 at the point where the head 14 is operatively joined to the handle 11. The end 13 of the handle 11 is merely a continuation of the main portion of the handle 11 telescopically extending into the hand grip 15 with the handle 11 along the main body portion thereof preferably being cylindrical.

Figure 2:
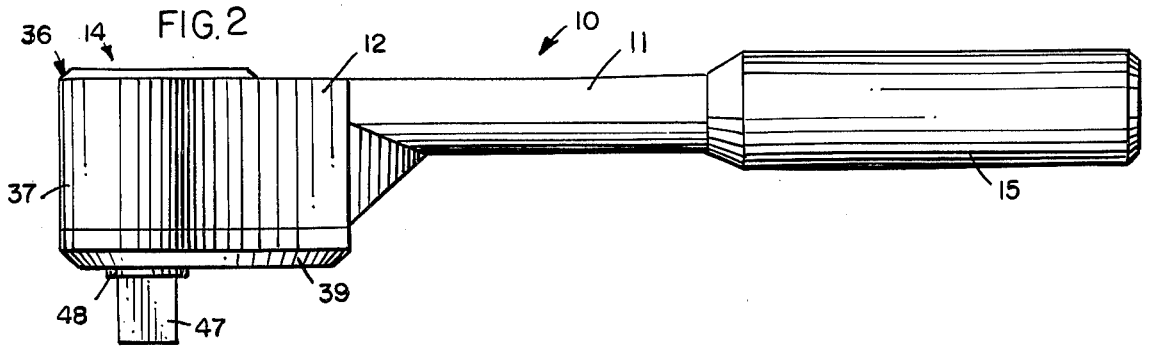
FIG. 2 is a side view of the speed handle ratchet of FIG. 1.
Figure 3:
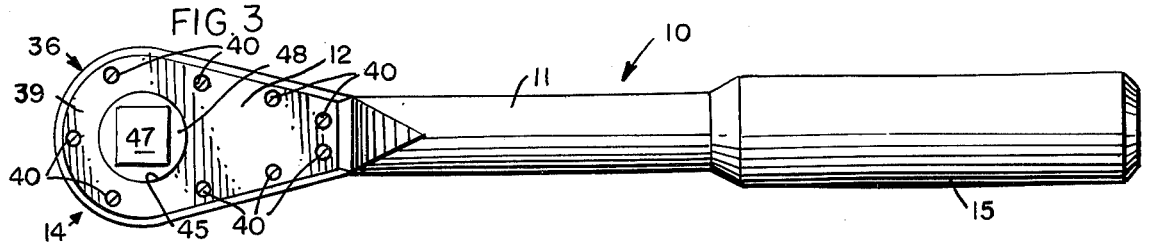
FIG. 3 is a bottom view of the speed handle ratchet of FIG. 1.

The head 14 includes a casing 36 having a side portion 37 (as shown in FIG. 2) integral with the end 12 of the handle 11 and a top portion 38 (as shown in FIG. 1) and a bottom portion 39 (as shown in FIG. 3) removably secured to the side portion 37 and the end 12 of the handle 11 by a plurality of fasteners 40 such as screws or rivets. The interior of the casing 36 includes a divider 41 which defines an upper compartment 42 and a lower compartment 43. The divider 41 is apertured as at 44 and the bottom portion 39 is apertured as at 45. The bevel gear 32 rides on the upper surface of the divider 41 in the upper compartment 42 being integrally associated with the wheel 33 through the aperture 44 by means of a connecting rod 46. The wheel 33 rides on the lower surface of the divider 41 and the upper surface of the bottom portion 39 being integrally connected through the aperture 45 to a lug 47 by means of a connecting rod 48. The lug 47 has a non-circular transverse cross-section such as a square (as shown in FIG. 3) to receive a socket or the like having a similarly sized and shaped opening therein with suitable attachment means therebetween such as ball and socket (not shown) all of which is conventional being known to those skilled in the art. The head 14 therefore includes operative elements in the form of the bevel gear 32, the wheel 33, and the lug 47.

The drive means 16 is further characterized by the rod 28 extending into the upper compartment 42 of the head 14. The end of the rod 28 carrying the bevel gear 31 is apertured as at 49 and the bevel gear 31 is apertured as at 50 to receive a cotter pin 51 to positively connect the bevel gear 31 to the rod 28. The rod 28 is normally so positioned that the bevel gear 31 meshes with the corresponding bevel gear 32 mounted in the head 14.

The pawl 34 is pivotally mounted on the pin 52 in the end 12 of the handle 11. The pin 52 extends through a suitable aperture 53 in the pawl 34 and is anchored in axially aligned recesses 54 and 55, respectively, in the end 12 of the handle 11 and the bottom portion 39 of the casing 36. The pawl 34 can be better understood by referring to FIG. 15 where the reversible nature of the ratchet 17 is illustrated. The wheel 33 coacts with either one of two toothed projections 56 and 57 of the pawl 34. The projections 56 and 57 form an acute angle with the apex being defined by the aperture 53. The pawl 34 can be pivoted about the rod 52 at the apex until either the teeth of the projection 56 or the teeth on the projection 57 are in contact with teeth on the wheel 33 depending upon whether counterclockwise or clockwise rotation of the lug 47 is desired. The ratchet means 17 also includes external means (not shown) for shifting the pawl 34 between these two operating positions.

The hand grip 15 is an elongated tubular member open at one end having an inner diameter approximately the same as the outer diameter of the handle 11. The closed end 58 of the handle 15 includes a cylindrical recess 59 coaxial with the aperture 27. The recess 59 and the aperture 27 cooperate to receive the shoulder screw 26 with the head thereof in recessed relationship within the recess 59. The screw 26 serves to connect the hand grip 15 to the insert element 21 of the clutch assembly 18.

Referring to FIGS. 6 through 8, the clutch assembly 18 can be better understood. The first portion or cylindrical insert element 21 includes a bore 60 therethrough transverse to the apertures 23 and the threaded aperture 25. The bore 60 is preferably located near the end of the insert element 21 remote from the closed end 58 of the hand grip 15. The rod 28 of the drive means 16 has one end thereof extending slightly into the threaded aperture 25 with a bore 61 transverse to the axis thereof corresponding to and alignable with the bore 60 in the insert element 21. The bore 60 and the bore 61 cooperate to receive a cotter pin 62 (as shown in FIG. 6) for positively fastening the rod 28 to the insert element 21.

The second portion of the coupling means 18 includes spring loaded pins 24 having flat heads 63. The pins 24 also include long shanks 64 which extend through coiled springs 65 into the apertures 23 in the insert element 21. The heads 63 of the pins 24 are urged into firm engagement with the closed end 58 of the hand grip 15 by the springs 65.

With the above construction, the speed handle ratchet 10 is very simple to use. The desired socket is placed on the lug 47 and the ratchet means 17 is set for either clockwise or counter-clockwise rotation of the lug 47 and the socket relative to the axis 19 for either tightening or loosening a nut or bolt. The user can employ the speed handle ratchet 10 to tighten a nut or bolt by first slightly starting the nut or the bolt with his fingers. The socket can then be placed on the nut or bolt with the ratchet means 17 properly set to utilize the hand grip 15 to draw the nut and bolt into approximately finger tight relation. The hand grip 15 is rotated about the axis 20 which will, in turn, impart rotational movement through the clutch assembly 18 to the rod 28. The flat heads 63 of the pins 24 are in firm frictional engagement with the closed end 58 of the hand grip 15 so that any rotation of the hand grip 15 is translated through the pins 24 to the insert element 21. Since the insert element 21 is positively connected to the rod 28, the rod 28 will also rotate in response to rotational movement of the hand grip 15. The bevel gear 31 is in turn rotated by the rotational movement of the rod 28 causing the bevel gear 32 which meshes with the bevel gear 31 to be driven thereby about the axis 19. The rotational movement of the bevel gear 32 also causes the connecting rod 46, the wheel 33, the connecting rod 48, the lug 47, and the socket connected thereto to rotate. The hand grip 15 can therefore be rotated with the movement being transmitted through the clutch assembly 18, the drive means 16, the head 14 and the socket to draw the nut and bolt up to approximately finger tight relation.

After the nut and bolt have been drawn up to approximately finger tight relation, further rotation of the hand grip 15 will not be transmitted since resistance to further rotation imparted by the nut and bolt will be carried back through the socket, the head 14, the drive means 16 and into the clutch assembly 18. At the point at which a selected torque load level is reached, the hand grip 15 will slip relative to the clutch assembly 18 since the torque being applied to the hand grip 15 will be greater than the frictional force holding the spring loaded pins 24 in firm engagement with the end 48 of the hand grip 15. Accordingly, the clutch assembly 18 is effective to transmit rotation of the hand grip 15 through the clutch assembly 18, the drive means 16, the head 14 and the socket only at or below a selected torque load level.

After the nut and bolt have been drawn up to approximately finger tight relation, the speed handle ratchet 10 can immediately be used in a conventional manner to further tighten the nut and bolt. The head 14 and the socket rotate in response to oscillation of the handle 11 to perform the further tightening operation. The rotation of the socket and the head 14 relative to the handle 11 does not impart rotational movement to the hand grip 15, however, because of the clutch assembly 18. The rotation of the head 14 and the socket will be transmitted through the drive means 16 to the clutch assembly 18 but the user will be holding the hand grip 15 to impart oscillation to the handle 11 relative to the head 14 with the holding force normally being well above the selected torque load level. The spring loaded pins 24 will therefore rotate relative to the end 58 of the hand grip 15 since the frictional force therebetween will have been overcome. The clutch assembly 18 therefore prevents rotation of the hand grip 15 by the drive means 16 during rotation of the socket and the head 14 in response to oscillation of the handle 11 above the selected torque load level.

If it is later desired to use the speed handle ratchet 10 to loosen and remove a nut and bolt, the operation above described is simply reversed. The ratchet means 17 is oppositely set so that oscillation of the handle 11 will cause the head 14 and the socket to rotate in the opposite direction. The oscillation of the handle 11 will again not cause the hand grip 15 to rotate as the nut and bolt are being broken loose and loosened to approximately finger tight relation because of the operation of the clutch assembly 18 above the selected torque load level as described above. Once the nut and bolt have been sufficiently loosened, the hand grip 15 can be used to further loosen and remove the nut and bolt. The rotation of the hand grip 15 will then be imparted to the nut and bolt because of the action of the clutch assembly 18 below the selected torque load level as described above. With this construction, the speed handle ratchet 10 of the present invention effectively provides a device automatically operable in either one of two operating modes without the need for manual mode selection due to the unique automatic clutch assembly 18 disclosed.

The clutch assembly 18 is adjustable to vary the selected torque load level below which rotation of the hand grip 15 is transmitted into rotation of the head 14 and the socket and above which rotation of the hand grip 15 is prevented during rotation of the head 14 and the socket in response to oscillation of the handle 11. The adjustment can be made in a very simple manner by simply advancing or retracting the shoulder screw 26. The movement of the screw 26 will, of course, vary the spring force of the pins 24 since the springs 65 will either be compressed or explanded as a result of the screw 26 being advanced or retracted. With a slot being provided in the head of the screw 26, it is a very simple matter using a conventional screw driver to vary the selected torque load level.

Referring again to FIGS. 4 and 5, an optional manual disengagement feature can be provided. The rod 28 is provided with a pair of longitudinally spaced annular grooves 66 and 67 near the end thereof adjacent the head 14. The grooves 66 and 67 are provided to cooperate with a spring detent 68 carried within a bore 69 in the end 12 of the handle 11. The spring detent 68 includes a helical coil spring 70 with balls 71 and 72 on opposite ends thereof. The ball 71 engages either one of the grooves 66 or 67 depending upon whether the rod 28 is in a position of engagement or disengagement and the ball 72 engages either one of two depressions 73 and 74 in the pawl 34 depending upon whether the ratchet means 17 is set for clockwise or counterclockwise rotation. With these additional structural features, the drive means 16 can be disengaged (as shown in FIG. 5) should it be desirable to do so although this is merely an optional feature which is not required due to the automatic operation of the clutch assembly 18.

In another form of the invention (as shown in FIG. 16) the speed handle ratchet 110 includes a somewhat different coupling means 118 and drive means 116. The drive means 116 again includes a longitudinally extending rod 128 which is carried in a central bore 135 in the handle 111. The rod 128 terminates, however, at the one end 112 of the handle 111 rather than extending into the head 114. The head 114 is then connected to the rod 128 by a cable 175. The cable 175 has one end positively connected to the end of the rod 128 adjacent the head 114 and has the other end positively connected to the lug 147 in the head 114. With this construction, rotational movement of the rod 128 is transmitted through the cable 175 to the head 114.

The coupling means 118 again includes a first portion 121 and a second portion 122. The first portion 121 of the coupling means 118 is a cylindrical insert element but the second portion of the coupling means 118 is a spring loaded disc 122. The disc 122 (as shown in FIG. 9) is disposed between the insert element 121 and the end 158 of the hand grip 115 being compressable and expandable to provide adjustability for varying the selected torque load level. The disc 122 preferably includes a central aperture 176 with a plurality of radially disposed circumferentially spaced upstanding tabs 177 constructed of spring steel. The hand grip 115 is connected to the coupling means 118 by means of a shoulder screw 126 which extends through a recess 159 and an aperture 127 in the closed end 158. The screw 126 cooperates with a threaded aperture 125 in the insert element 121 and can be advanced or retracted to vary the selected torque load level in a manner very similar to that described above in connection with the first embodiment. The coupling means 118 is positively connected to the rod 128 by means of a pin 162 which extends through an aperture 160 in the insert element 121 and an aperture 161 in the rod 128. With respect to the other structural details of the speed handle ratchet 110, such details of construction are either similar to those described in connection with the first embodiment or otherwise conventional and readily available and known to those skilled in the art with the operation thereof being identical to that described above.

The present invention therefore provides a unique speed handle ratchet with a coupling means that engages and disengages automatically at a selected torque load level permitting the ratchet to be used in a conventional manner by oscillating the handle as well as in a second unique manner by rotating the hand grip. This eliminates the need for manual engagement and disengagement of the second mode of operation for tightening or loosening a nut or bolt as well as at burr stops. In the prior art, manual engagement and disengagement is required and depending upon the amount of stress, must either be done with two hands or in the event of extreme gear stress may not be accomplished at all. This leads to a reduction of gear teeth edge over a period of sustained heavy use with extreme friction stress sometimes resulting in strippage of the gear teeth themselves. With the present invention this is not possible because the coupling means disengages automatically above a selected torque load level.

The present invention therefore provides a speed handle ratchet in which rotation of the nut or bolt may be achieved by simply rotating the hand grip about its own axis in the same manner as the handle of a screw driver is rotated as the nut or bolt is being threaded into place for final tightening or after it has been broken loose and is being unthreaded for removal. The device may be used in a conventional manner for exerting maximum force and may be used in screw driver fashion when only minimum force is required. A friction clutch assembly is provided to accomplish these objectives so that the hand grip will not rotate about its own axis in the user's hand during a normal ratcheting operation. The device is characterized by quickness and ease of operation in removing or tightening a nut or bolt from beginning to end since the speed handle ratchet does not have to be removed once it is placed on the nut or bolt until complete removal or tightening of the nut or bolt. With the features above described, the speed handle ratchet of the present invention fully accomplishes the objective of providing a device which can automatically be used in either one of two distinct operating modes in the manner described.

While in the foregoing specification a detailed description of the inventio has been set forth for the purpose of illustration, variations of the details herein given may be made by those skilled in the art without departing from the spirit and scope of the invention.

I claim:

1. A speed handle ratchet comprising an elongated handle having first and second ends, a head on one end of said handle mounted for rotation about a first axis transverse to said handle, a hand grip on the other end of said handle mounted for rotation about a second axis parallel to said handle, drive means connecting said hand grip to said head for rotation of said head in response to rotation of said hand grip, ratchet means at the one end of said handle operatively joining said handle to said head for rotation of said head in response to oscillation of said handle, and coupling means at the other end of said handle operatively joining said hand grip to said drive means, said coupling means transmitting rotation of said hand grip through said drive means into rotation of said head below a selected torque load level, and said coupling means preventing rotation of said hand grip by said drive means during rotation of said head in response to oscillation of said handle above the selected torque load level.

2. The device of claim 1 in which said coupling means includes a clutch assembly having a first portion connected to said drive means and a second portion urged into firm frictional engagement with said hand grip.

3. The device of claim 2 in which said clutch assembly is adjustable to vary the selected torque load level below which rotation of said hand grip is transmitted into rotation of said head and above which rotation of said hand grip is prevented during rotation of said head in response to oscillation of said handle.

4. The device of claim 2 in which said first portion of said clutch assembly includes a cylindrical insert element and second portion of said clutch assembly includes a spring loaded disc disposed between said insert element and said hand grip.

5. The device of claim 2 in which said first portion of said clutch assembly includes a cylindrical insert element having an aperture therein and said second portion of said clutch assembly includes a spring loaded pin extending from said aperture in said insert element.

6. The device of claim 5 in which said cylindrical insert element includes a plurality of radially disposed, circumferentially spaced apertures therein with a spring loaded pin extending from each of said apertures in said insert element.

7. The device of claim 6 in which said cylindrical insert element includes a threaded central aperture to receive a screw passing through an aperture in said hand grip.

8. The device of claim 2 in which said drive means includes a longitudinally extending rod having one end connected to said first portion of said clutch assembly and having the other end connected to said head.

9. The device of claim 8 in which the end of said rod adjacent said head includes a bevel gear to mesh with a corresponding bevel gear fixed to said head.

10. The device of claim 8 in which said drive means includes a cable having one end connected to the end of said rod adjacent said head and having the other end connected to said head.

11. The device of claim 2 in which said ratchet means includes a wheel fixed to said head and a pawl operatively engageable with said wheel connected to said handle.

12. The device of claim 11 in which said ratchet means is reversible.

* * * * *